United States Patent [19]

Lewis et al.

[11] 4,398,113

[45] Aug. 9, 1983

[54] FIBER BRUSH SLIP RING ASSEMBLY

[75] Inventors: Norris E. Lewis; Jean A. Skiles, both of Christiansburg, Va.

[73] Assignee: Litton Systems, Inc., Blacksburg, Va.

[21] Appl. No.: 216,133

[22] Filed: Dec. 15, 1980

[51] Int. Cl.[3] ..... H01R 39/08

[52] U.S. Cl. ..... 310/232; 310/248

[58] Field of Search ..... 310/239, 231, 232, 248-252; 339/5 R, 5 M, 5 P, 5 S

[56] References Cited

U.S. PATENT DOCUMENTS

| | | | |
|---|---|---|---|
| 849,643 | 4/1907 | Spiers | 310/251 |
| 920,626 | 5/1909 | Noeggerath | 310/251 |
| 2,939,977 | 6/1960 | Forster et al. | 310/248 |
| 3,153,163 | 10/1964 | Foldes et al. | 310/231 |
| 3,243,866 | 4/1966 | Pandapas | 310/232 |
| 3,270,306 | 8/1966 | Burski | 336/148 |
| 3,329,923 | 7/1967 | Davis | 310/232 UX |
| 3,488,312 | 6/1969 | Mashburn | 310/239 |
| 3,525,006 | 8/1970 | Parr et al. | 310/251 |
| 3,668,451 | 6/1972 | McNab | 310/248 |
| 3,688,142 | 8/1972 | Förste | 310/232 |
| 3,821,024 | 6/1974 | Wilkin et al. | 117/217 |
| 4,000,430 | 12/1976 | Bely et al. | 310/251 |
| 4,267,476 | 5/1981 | Lee | 310/251 |
| 4,277,708 | 7/1981 | McNab | 310/248 |
| 4,347,456 | 8/1982 | Chabrerie | 310/248 |

OTHER PUBLICATIONS

I. R. McNab and W. R. Gass, "High Current Density Carbon Fiber Brush Experiments in Humidified Air and Helium"; *Proc. Electrical Contacts,* 1979, pp. 159-163.

C. M. Adkins III and D. Kuhlmann-Wilsdorf, "Development of High Performance II—Testing & Properties", *Proc. Electrical Contacts,* 1979, pp. 171-184.

P. Reichner "Metallic Brushes for Extreme High Current Applications", *Proc. Electrical Contacts,* 1979, pp. 191-195.

C. M. Adkins III and D. Kuhlmann-Wilsdorf, "Development of High-Performance Metal Fiber Brushes I—Background and Manufacture", *Proc. Electrical Contacts,* 1979, pp. 165-169.

*Primary Examiner*—R. Skudy

*Attorney, Agent, or Firm*—Brian L. Ribando

[57] ABSTRACT

A slip ring and brush assembly comprises a gold plated slip ring surface and a bundle of conductive fibers in the 2 to 3 mil size range. During use, gold transfers from the ring to the fibers, and the resulting gold-on-gold contact interface of ring and brush is extremely noise free and long wearing.

6 Claims, 8 Drawing Figures

Fig_1
(Prior Art)
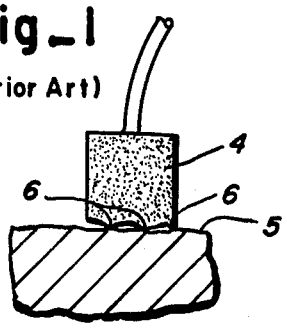
Fig_2
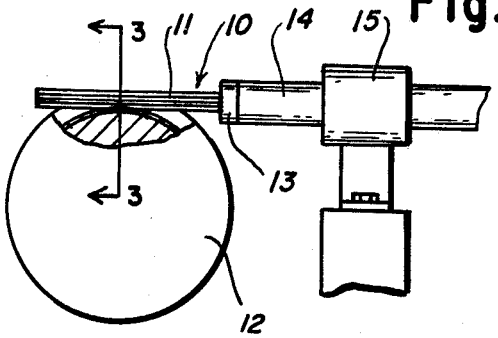
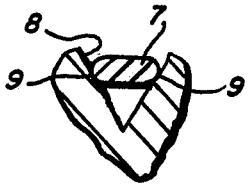
Fig_1A
(Prior Art)
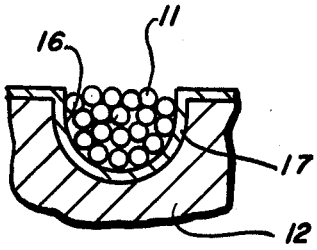
Fig_3
Fig_4
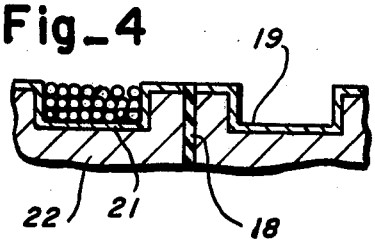
Fig_5
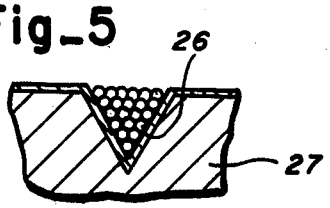
Fig_6
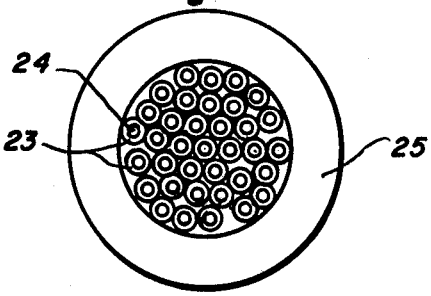
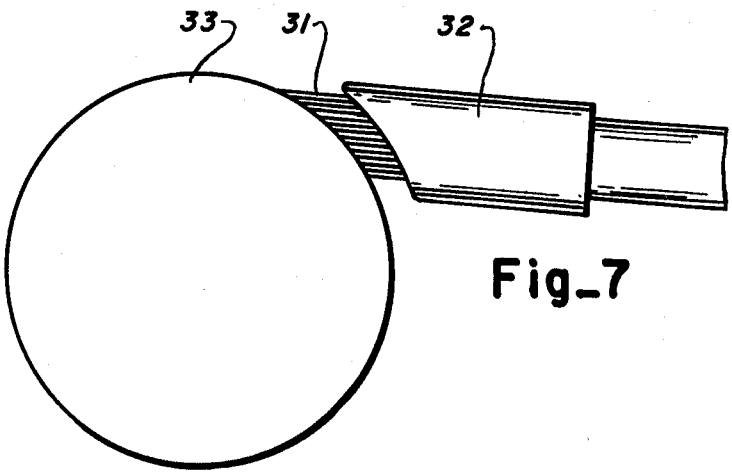
Fig_7

FIBER BRUSH SLIP RING ASSEMBLY

BACKGROUND OF THE INVENTION

Slip ring assemblies are well known in the prior art. Such assemblies generally comprise a rotating conductive ring which is contacted by a non-rotating brush mounted in a suitable brush holder. The "brush" is often a monolithic element comprising a composite of carbon and other materials. The carbon provides lubrication between ring and brush and the other materials, such as silver or copper, provide flow paths for electrical power or signals. Although the surface of the brush which is in contact with the rotating ring is configured to match the curvature of the ring, irregularities in the ring surface and uneven wear properties of the brush limit contact between the brush and the ring to only a few discrete points.

The "brush" may also be a metallic member which can have a rectangular or a cylindrical crossection. In the slip ring industry, this type of monofilament member is called a "wire brush". Typical contact geometry for a wire brush and ring is shown in U.S. Pat. No. 3,329,923. As is the case with the monolithic composite brush, the contact between the ring and such a wire brush is limited to only a few discrete points.

These discrete points of contact between the brush and the ring causes the brush biasing force to be concentrated on these few point surfaces. This concentration of force results in localized high pressures on these few points and this leads to wear of both the brush and ring surface. The resultant wear debris contributes electrical resistance to the flow path of electricity through the assembly.

Slip ring assemblies employed in instrumentation systems to transmit signal level voltages are expected to operate for long periods of time (years) with contact resistance variations in the low milliohm levels. It has been known for some time that to achieve this performance, single element wire brush assemblies comprising noble metals and noble metal alloys must be used in the electrical contact zone rather than base metals. Base metals will oxidize if not maintained in an inert environment and the resultant semi-conducting oxide layer contributes electrical resistance to the flow path of electricity through the assembly. While high contact forces can be used to disrupt the oxide layer to achieve better electrical contact, such contact forces result in very high wear rates.

Experience has also shown that a suitable lubricant must be used to reduce friction and wear between noble-metal-wire-brushes and noble-metal-rings. When these slip ring assemblies are used in vacuum environments, a low vapor pressure lubricant is required to prevent cold welding of the contacts to the ring.

Present day research is being directed to slip ring assemblies comprising non-noble fiber brushes (e.g. copper, nickel, brass, etc., fibers) which ride on a non-noble slip ring surface. In order to prevent the deleterious effects of oxide layers on the non-noble slip ring components, the assemblies require an environment comprising an inert gas. Such environments are producible, but not without elaborate equipment. As an example, it has been determined that a humidified inert gas produces a greater conductivity between the slip ring components. This is often impractical where space is a consideration or where the attendant cost is prohibitive. Drawn fibers of solid gold running on a gold slip ring surface have also been proposed, but for most applications this approach is too costly.

SUMMARY OF THE INVENTION

This invention relates to a slip ring and brush assembly comprising a multifilament fiber brush in contact with a gold slip ring surface. The force which biases the multifilament brush to the slip ring surface is distributed over a large number of brush fibers which are in actual physical contact with the slip ring surface. This results in a very low force being exerted on the ring by each fiber. The low localized pressure provides a brush of exceptionally long wearing characteristics and the multiplicity of contact points between the multifilament brush and the slip ring result in a lower overall electrical contact resistance for the assembly. The balance of the filaments comprising the brush which are not in contact with the ring provide a damping mechanism to those filaments which contact the ring. This mechanism enhances the contact between the filaments and the ring by prevention of hydrodynamic and/or pneumatic lift, as well as lift or bounce resulting from shock. These additional filaments also provide parallel paths for the flow of electricity to the vicinity of sliding contact.

It is advantageous in many instances to initially gold plate both the surface of the ring and the fibers of the multifilament brush. The gold on the ring should be plated to at least 200 micro-inches thickness and should be chosen to have a hardness which is less than the hardness of the gold on the filament brushes. During an initial "run-in" stage, the softer gold on the ring will transfer from the ring and will cold weld onto the harder gold plating on the brush at those points of the brush in actual contact with the ring. It will be appreciated that using this technique, gold is transferred onto the thin plating of the fibers, rather than being worn away. Once this transfer has taken place, the resulting gold-on-gold interface of ring and brush is highly conductive, and the tangential force between the fibers and the ring surface may be maintained very low.

This invention is not limited to assemblies in which gold plated fibers ride on a gold plated ring, but includes applications in which non-noble fibers ride on a gold plated ring whereby a transfer of gold occurs from the rotating ring surface to those portions of the non-noble fibers in contact with the ring. After the initial oxide layer on the non-noble fibers is abraded away by the rotating ring, gold will be transferred to the electrical contact zone of the brush where it is most critically needed. Such arrangements allow the use of non-noble fibers which may have desirable properties of low cost, electrical resistivity, tensile strength, corrosion resistance, and the like. This approach has been tested whereby nickel fibers have been successfully run on a gold plated surface for more than one billion inches of ring travel with current densities in excess of 5000 Amps/sq. in. Fibers may also be fabricated from copper, copper alloys, nickel, nickel alloys, other metals, and metal alloys which can be formed into wire.

BRIEF DESCRIPTION OF THE DRAWINGS

FIGS. 1 and 1A show prior art brushes.

FIG. 2 shows a fiber brush in tangential contact with a slip ring.

FIG. 3 is a view taken along line 3—3 of FIG. 2.

FIGS. 4–5 show fiber brushes in alternatively configured slip ring channels.

FIG. 6 shows an end view of a fiber brush comprising plated fibers.

FIG. 7 shows a fiber brush in fiber end contact with a slip ring.

DESCRIPTION OF THE PREFERRED EMBODIMENT

FIG. 1 shows generally a prior art monolithic composite brush 4 in contact with a slip ring surface 5. Although the face of the brush 4 is contoured to match the shape of the ring, contact exists at only a few discrete points 6. These points 6 receive the total force biasing the brush to the ring and are areas of abrasion and wear.

FIG. 1A shows a prior art wire brush comprising a single metallic spring element 7. Like the composite brush 4, the spring element contacts the slip ring surface 8 at only a few discrete points 9.

A single element brush exhibits significant electrical losses due to constriction resistance. Constriction resistance is proportional to $n^{-\frac{1}{2}}$, where n is the number of spots which carry current between the brush and the ring. It is estimated that in a single element brush, n varies between 1 and 20.

As shown in FIG. 2, a slip ring and brush assembly according to the invention may comprise a multifilament brush 10 which is in contact with a rotating slip ring 12. The multifilament brush 10 comprises a plurality of filaments 11 in the 1 to 3 mil size which are held in a unitary relationship by means of a collar 13. The collar 13 may comprise the end portion of the wire insulation 14, or may be a separate element specifically designed to hold the fibers 11 in a selectively shaped bundle. As shown, the fibers 11 extend from the collar 13 a sufficient distance to enable them to be in tangential contact with the ring 12, and are held in position by a holder 15.

The surface of the ring 12 may be flat or may be formed with one or more channels 16, as shown in FIG. 3. Each channel 16 comprises a plating 17 of gold on the base metal of the ring 12. The channels 16 group the filaments 11 to prevent spreading of the filaments 11 across the surface of the slip ring, and the sides of the channels present additional surface area which the brush filaments 11 contact.

Turning now to FIG. 4, it will be seen that the channel may take the form of a rectangular trough 19, comprising a gold plating 21 formed on the base metal ring 22. An insulating spacer 18 is provided between adjacent troughs 19 to create separate circuits on a common ring structure.

As shown in FIG. 5, the slip ring may comprise a V-shaped channel 26 formed in the slip ring surface 27. In each of the embodiments shown by FIGS. 3–5, the channels are sized so as to be substantially filled by the fibers of the brush with which they will be used. In each of the embodiments shown by FIGS. 3–5, bidirectional operation of the ring is possible when the free length of the fiber is maintained below a critical value. In most fiber brush systems under development today, bidirectional operation is not possible.

The fiber brushes of FIGS. 2–5 offer a number of advantages over a single element brush. The separate fibers create a large number of current carrying spots, thus drastically lowering electrical resistance and increasing current density. In a monolithic brush, maximum current density is 600 amp per square inch, while with fiber brushes, current densities of 20,000 amp per square inch can be realized.

The individual brush fibers are able to adapt to the unevenness of the ring surface because of their elasticity and flexibility. The fibers in actual contact with the ring are biased by other fibers which comprise the brush. These properties also greatly reduce brush bounce caused when the brush hits a high spot on the ring surface at high ring speed.

The fact that brush bounce is greatly reduced and the fact that the need for lubrication is minimized because of the very low forces between contact members permit the fiber brush contact system to be operated in conjunction with very high ring speeds. Tests to date have shown that the adventitious lubricants in the environment, i.e., hydrocarbons and other airbourn gaseous contaminants, will provide adequate lubrication such that fiber brush contact assemblies can be operated for periods of time in excess of 50 hours at speeds of 30,000 RPM.

Slip ring assemblies used in instrumentation systems to monitor a parameter such as temperature on the rotating portion of turbine engine may be required to operate at speeds of 10,000 to 60,000 RPM. In these systems, auxiliary equipment is required to cool a Freon TF® and oil mixture which is circulated throughout the slip ring assembly in order to remove the heat generated by friction between the contacts and the ring. In prior art slip ring assemblies designed for a high speed, the force between the single element wire-brush and the rotating ring is typically 20 grams. This force is more than two orders of magnitude greater than the force required to hold the fibers of a fiber brush against a ring such that electrical noise in the low milliohm levels can be achieved with the rotating ring. Thus, such fiber brush contact assemblies designed for high speed applications permit instrumentation systems to be employed on engines while in flights, whereas prior art systems are limited to ground operation because of the bulk of the auxiliary cooling apparatus required.

The plurality of fibers allow maximum overall brush contact with minimum pressure per fiber. A brush life of 1.4 billion inches of ring travel can be expected with fiber brushes while monolithic brushes generally cannot exceed 10 million inches of ring travel. Since fiber brushes can be biased to the slip ring surface with a force which is two orders of magnitude less than the force which biases a conventional brush in a similar application, the necessity for lubrication othewise necessary to reduce friction between the two surfaces is obviated. Film resistance caused by the lubricant is eliminated, and since the number of discrete current carrying spots for a fiber brush can vary from 50 to 10,000, constriction resistance is minimal.

The low force required to sucessfully use the fiber brush system eliminates technological problems in vacuum applications. Typically, the force used to bias a single element wire-brush to a slip ring in a vacuum environment is sufficient to cold weld the brush to the ring if a lubricant is not used. To find a contact lubricant which meets all of the necessary requirements of viscosity, vapor pressure, chemical stability, and chemical compatibility with the system over a wide temperature range is a formidable task. Using fiber brushes of the present invention, gold plated fibers, nickel fibers and fibers of a copper silver alloy have been successfully run without lubricant on gold plated rings in excess of 1,500 hours in a minimum vacuum of $2\times10^{-7}$ torr (500 of these hours at $6\times10^{-8}$ torr) without evidence of cold welding.

As shown in FIG. 6, the fiber brush itself may comprise a gold plating 23 over a bundle of base filaments 24. The bundle is maintained in a unitary relationship by a collar 25 and the base filaments 24 may be formed of a plurality of materials but preferably are a conductive metal such as beryllium copper, copper, nickel, or phosphor bronze. In actual practice, filaments in the 2 to 3 mil size have been used but other sizes may be substituted where desired.

As shown in FIG. 7, a high current carrying capacity brush may comprise a plurality of filaments 31 configured by a holder 32 to contact a ring surface 33 so that the ends of the filaments are in contact with the ring. Such an arrangement provides for a greater number of filaments 31 contacting the ring 33 than would otherwise occur if the filaments were tangential to the ring. In actual practice, the number of fibers in a fiber brush may vary between 50 and 10,000. In the configuration shown in FIG. 7, a very high percentage of those fibers comprising the brush will actually contact the ring. Using such configurations, 20,000 amps per square inch of brush surface area can be transferred to a rotating ring without deleterious effects to either the ring or the brush.

What we claim as our invention is:

1. A slip ring and brush assembly for transmitting electrical energy between a stationary conductor and a rotating shaft, the assembly comprising:

a gold plated slip ring surface on the rotating shaft, a fiber brush in contact with said gold plated slip ring surface and coupled to the stationary conductor, the fibers of said brush each being from 1 to 3 mils in diameter and being maintained in a bundle of between 20 and 10,000 fibers by a collar located on said bundle at a point spaced from the fiber ends, a brush holder for maintaining said fiber brush in contact with said gold plated slip ring, said brush holder biasing said brush against said slip ring surface, said gold plated slip ring surface having a hardness which is less than the hardness of the fibers of said brush, whereby during use gold is transferred from the gold plated slip ring surface to the regions of the fibers in actual contact with the slip ring, whereby said slip ring and brush assembly will withstand at least 20 million inches of ring travel and is capable of transmitting current in excess of 7,000 amps per square inch without lubrication between ring and brush.

2. The slip ring and brush assembly of claim 1 wherein the fibers of said fiber brush comprise a material selected from the group comprising copper, beryllium copper, nickel, and phosphor bronze.

3. The slip ring and brush assembly of claim 2 wherein the fibers are plated with gold having a hardness which is greater than the hardness of the gold on the slip ring surface.

4. The slip ring and brush assembly of claim 1 wherein the brush holder positions the fiber ends of the brush in contact with the slip ring surface, whereby approximately 75% of the fibers comprising the fiber brush are in contact with the slip ring surface to allow the transfer of a great quantity of electrical energy.

5. The slip ring and brush assembly of claim 1 wherein the fibers of the fiber brush are in tangential contact with the slip ring surface and the fiber ends overlie the slip ring surface.

6. The slip ring and brush assembly of claim 1 wherein the gold plated slip ring surface comprises a number of channels, one for each fiber brush, and whereby the fibers of the fiber brush are contained by and contact the sides of the channels creating greater surface area contact with the slip ring.

* * * * *